US007490422B1

(12) United States Patent
Chen

(10) Patent No.: US 7,490,422 B1
(45) Date of Patent: Feb. 17, 2009

(54) ELECTRIC STEAM IRON

(75) Inventor: Hsi-Fu Chen, Changhua (TW)

(73) Assignee: Mitco International Ltd., Taipei (TW)

( * ) Notice: Subject to any disclaimer, the term of this patent is extended or adjusted under 35 U.S.C. 154(b) by 0 days.

(21) Appl. No.: 12/034,207

(22) Filed: Feb. 20, 2008

(30) Foreign Application Priority Data

Dec. 4, 2007 (CN) ..... 2007 2 0194280 X

(51) Int. Cl.
*D06F 75/20* (2006.01)
*D06F 75/10* (2006.01)

(52) U.S. Cl. ..... 38/75; 38/77.1; 38/77.3

(58) Field of Classification Search ..... 38/77.1–77.9, 38/85, 88, 93, 94; 219/245; 251/149, 149.1, 251/147, 325; 285/95, 122.1, 125.1
See application file for complete search history.

(56) References Cited

U.S. PATENT DOCUMENTS 2,713,225 A * 7/1955 Wolcott ..... 38/99
3,001,305 A * 9/1961 Sardeson ..... 38/77.5
3,077,900 A * 2/1963 Ehrmann et al. ..... 239/407
3,983,644 A * 10/1976 Gowdy ..... 38/77.83
4,692,588 A * 9/1987 Cavalli ..... 219/245
5,526,594 A * 6/1996 Fourny et al. ..... 38/77.5
5,621,988 A * 4/1997 Bouleau et al. ..... 38/77.3
5,638,622 A * 6/1997 Hohn ..... 38/77.5
6,009,645 A * 1/2000 Shimizu et al. ..... 38/77.5
6,061,935 A * 5/2000 Lee ..... 38/77.6
6,176,026 B1 * 1/2001 Leung ..... 38/96
6,935,056 B2 * 8/2005 Milanese ..... 38/77.5
7,389,597 B1 * 6/2008 Chen ..... 38/77.83
7,415,784 B2 * 8/2008 Song ..... 38/77.83
2006/0213092 A1 * 9/2006 Di Leta ..... 38/77.1

* cited by examiner

*Primary Examiner*—Ismael Izaguirre
(74) *Attorney, Agent, or Firm*—Browdy and Neimark, P.L.L.C.

(57) ABSTRACT

An electric steam iron includes a steam generator with an output port, a switching device formed of a body and a movable member. The body has an inlet in air communication with the output port, a first outlet, a second outlet, a first passage in air communication with the inlet and the first outlet, and a second passage in air communication with the inlet and the second outlet. The movable member is disposed in the intersection between the first passage and the second passage and movable between a first position where steam goes out of the first outlet and a second position where steam goes out of the second passage. A cleaning device has a connector for connection to the body of the switching device to move the movable member from the first position to the second position and a nozzle connected to the connector for steam output.

6 Claims, 4 Drawing Sheets

ELECTRIC STEAM IRON

BACKGROUND OF THE INVENTION

1. Field of the Invention

The present invention relates to an iron for making clothes smooth and flat and more particularly, to an electric steam iron that provides ironing and steam cleaning functions.

2. Description of the Related Art

An ordinary steam iron essentially comprises a steam generator and an ironing unit connected with the steam generator. The ironing unit has multiple through holes for steam output. When in use, the user presses the ironing unit on the clothes and uses the steam to remove wrinkles from the clothes, thereby making the clothes smooth and flat.

However, an ordinary steam iron is designed for horizontal ironing. When ironing, the clothes must be spread out horizontally on a flat surface. This design has its limitation in application, i.e., an ordinary steam iron is not suitable for vertical ironing to remove wrinkles from hung clothes.

Therefore, it is desirable to provide an electric steam iron that eliminates the application limitation drawback of the conventional design.

SUMMARY OF THE INVENTION

The present invention has been accomplished under the circumstances in view. It is the primary objective of the present invention to provide an electric steam iron that allows the user to iron clothes in horizontal direction as well as in vertical direction, bringing convenience.

To achieve this objective of the present invention, the electric steam iron comprises a steam generator, a switching device, an ironing unit, and a cleaning device. The steam generator has an output port for steam output. The switching device comprises a body and a movable member. The body of the switching device has an inlet, a first passage, and a second passage. The inlet is in air communication with the output port of the steam generator. The first passage has a first end in air communication with the inlet, and a second end terminating in a first outlet. The second passage has a first end in air communication with the inlet, and a second end terminating in a second outlet. The movable member is disposed in an intersection between the first passage and the second passage, and movable between a first position where the second outlet is blocked by the moveable member and steam goes out of the first outlet and a second position wherein the first outlet is blocked by the moveable member and steam goes out of the second outlet. The ironing unit comprises a connection hole in air communication with the first outlet for steam input, and a plurality of steam holes on a bottom side thereof in air communication with the connection hole for steam output. The cleaning device comprises a connector, a flexible tube, and a nozzle. The connector is connectable to the body of the switching device for pushing the movable member to the second position. The flexible tube is connected between the connector and the nozzle to guide steam from the second passage to the nozzle. As a result, when the movable member is in the first position, steam goes through the first outlet to the connection hole of the ironing unit. When the movable member is moved to the second position upon connection of the connector to the body of the switching device, steam goes through the second outlet to the nozzle of the cleaning device.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWING

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
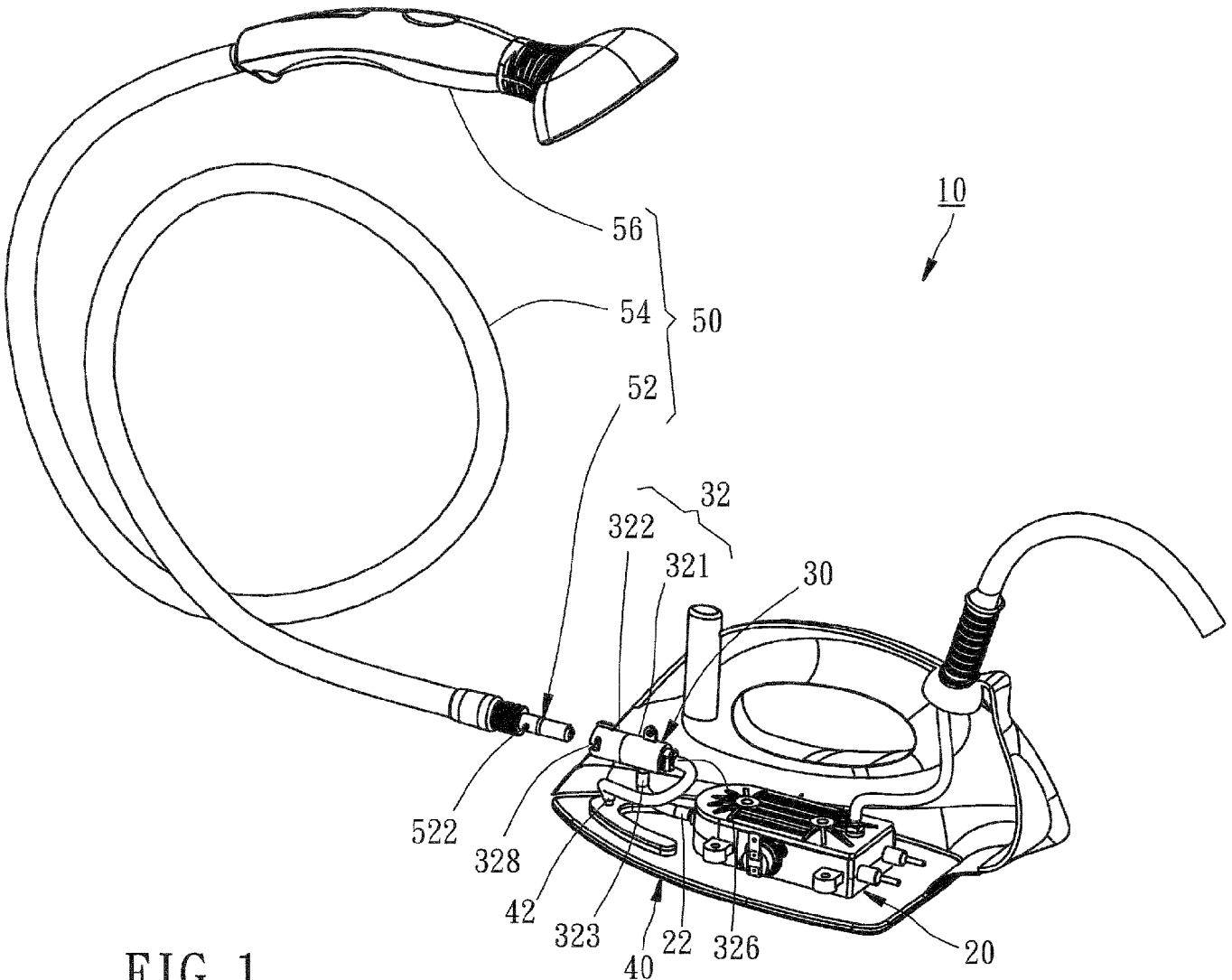
FIG. 1 is a schematic drawing showing the structure of an electric steam iron in accordance with an exemplary embodiment of the present invention.
Figure 2:
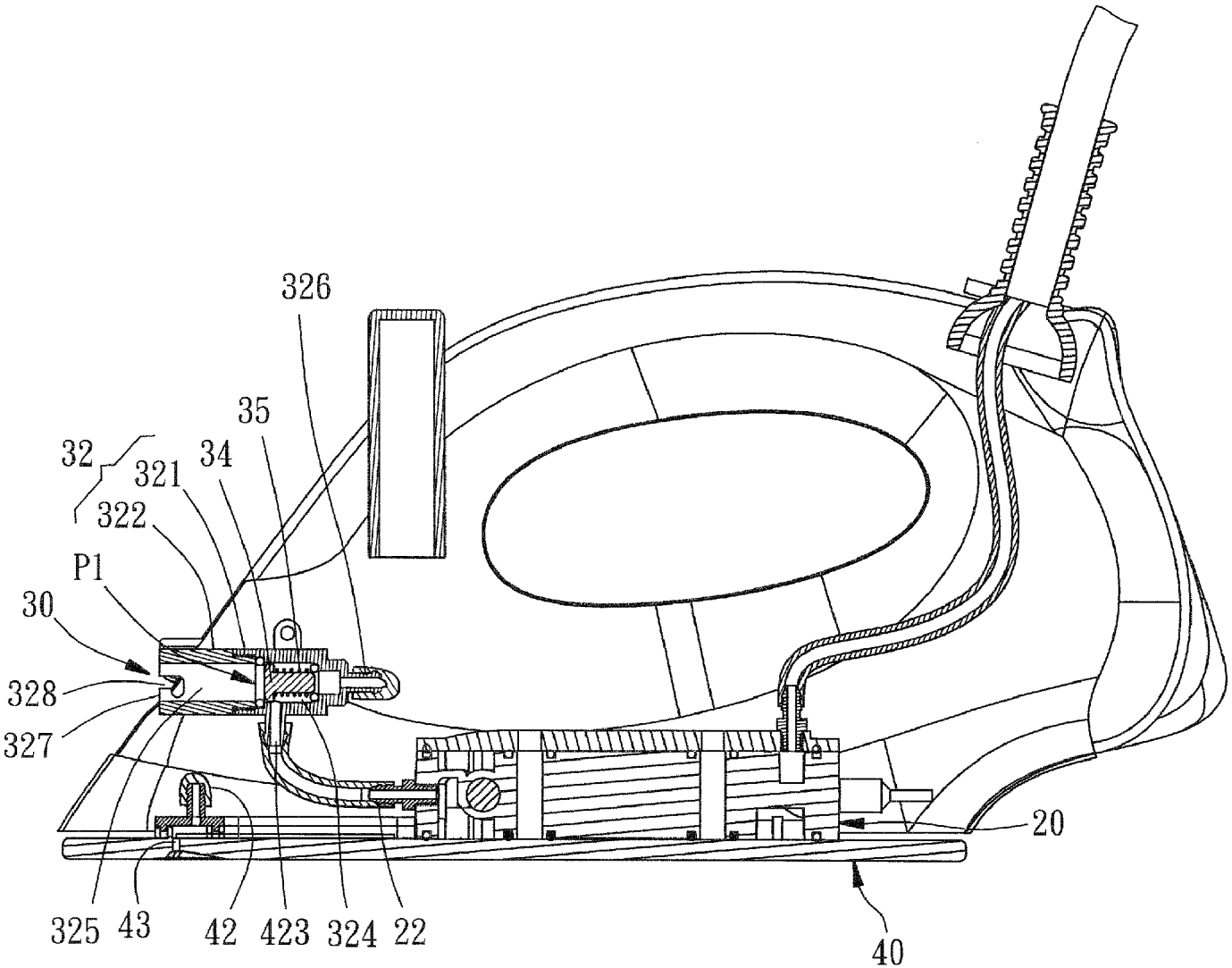
FIG. 2 is a sectional view in an enlarged scale of a part of the electric steam iron shown in FIG. 1.
Figure 3:
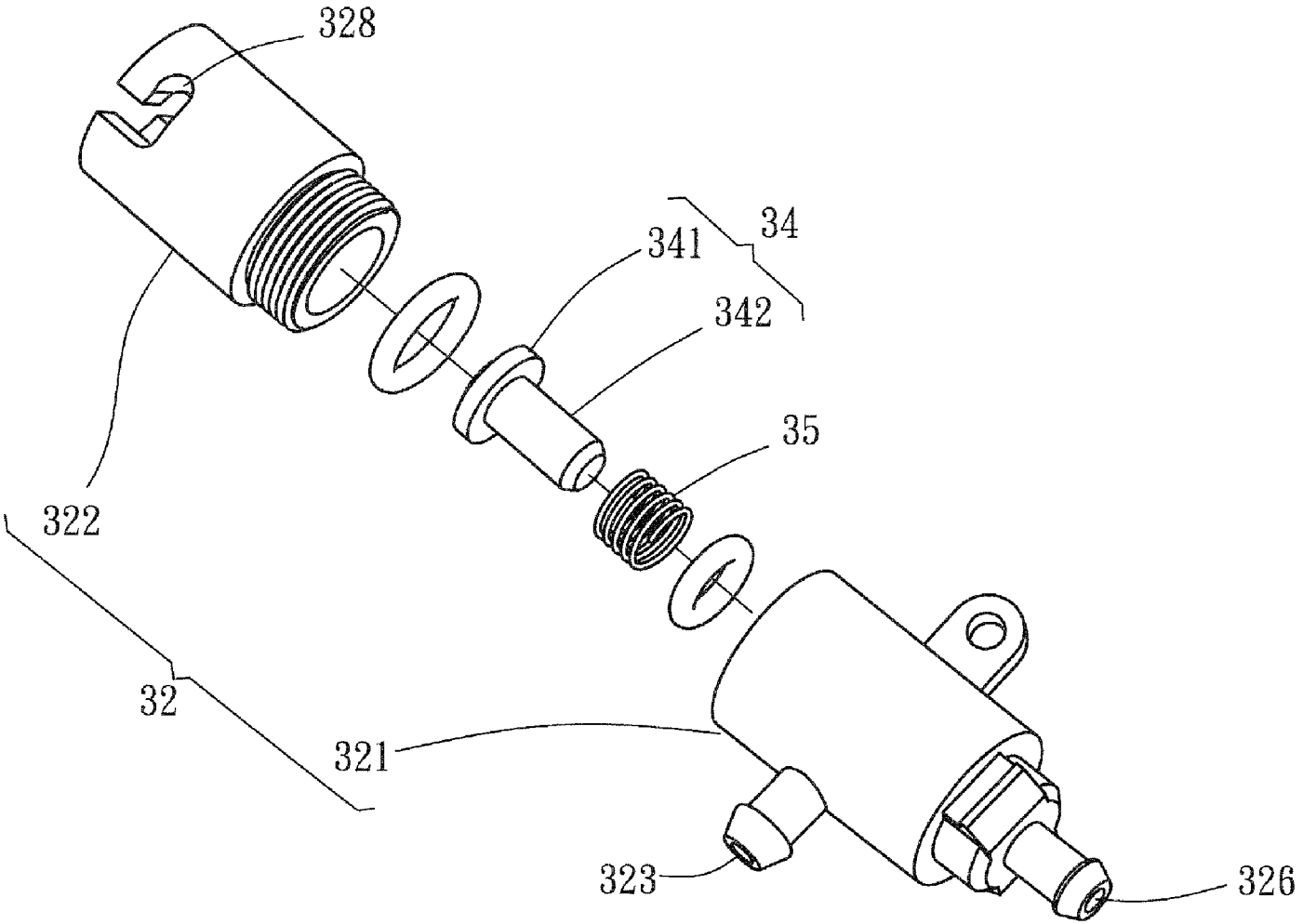
FIG. 3 is an exploded view of the switching device of the electric steam iron in accordance with the exemplary embodiment of the present invention.
Figure 4:
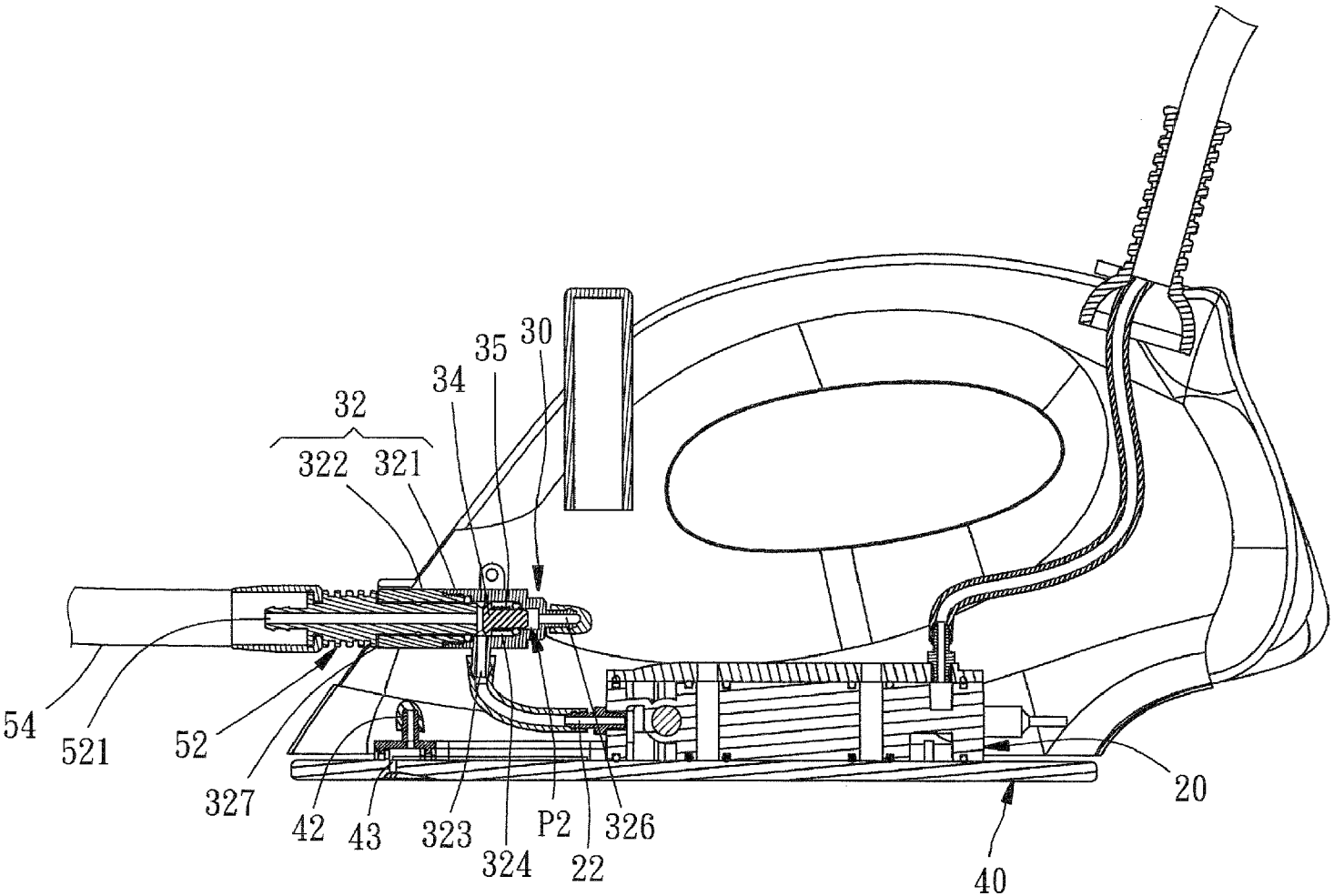
FIG. 4 is similar to FIG. 2, but showing that the connector is connected to the socket of the body of the switching device.

Referring to FIGS. 1-4, an electric steam iron 10 in accordance with an exemplary embodiment of the present invention is shown comprising a steam generator 20, a switching device 30, an ironing unit 40, and a cleaning device 50.

The steam generator 20 is adapted to generate steam, having an output port 22 for steam output. The steam generator 20 is similar to the steam supply mechanism of an ordinary steam iron; therefore, detailed description in this regard is not necessary hereinunder.

The switching device 30 comprises a body 32, and a movable member 34. The body 32 is comprised of a valve block 321 and a socket 322. The socket 322 is fixedly connected to the rear end of the valve block 321. The movable member 34 is movable in the valve block 321. The body 32 has an inlet 323, a first passage 324, and a second passage 325. The inlet 323 is connected to the output port 22 of the steam generator 20 by a hose so that steam goes out of the steam generator 20 into the body 32. The first passage 324 has one end in air communication with the inlet 323, and the other end terminating in a first outlet 326. The second passage 325 has one end in air communication with the inlet 323, and the other end terminating in a second outlet 327. The socket 322 of the body 32 has two sliding slots 328. The sliding slots 328 respectively extend from one end of the socket 322 in an axial direction to a certain length and then turn perpendicularly in a transverse direction, and are adapted for the mounting of the cleaning device 50. The movable member 34 is disposed in the intersection between the first passage 324 and the second passage 325, and movable between a first position P1 and a second position P2. The movable member 34 has a head 341 and a body 342. The head 341 has an outer diameter greater than the outer diameter of the body 342. The switching device 30 further comprises a spring 35. The spring 35 is sleeved onto the body 342 of the movable member 34 and stopped between the head 341 of the movable member 34 and the valve block 321 of the body 32 of the switching device 30, and providing a biasing force to support/return the movable member 34 to the first position P1. When the movable member 34 is in the first position P1, it blocks the second passage 325, allowing steam to go out of the first outlet 326. When the movable member 34 is in the second position P2, it blocks the first passage 324, allowing steam to go out of the second outlet 327.

The ironing unit 40 is a plate member having a connection hole 42 connected to the first outlet 326 of the switching device 30 by a hose for steam input. The other end of the connection hole 42 is in air communication with multiple steam holes 43 on the bottom side of the ironing unit 40 for steam output.

The cleaning device 50 comprises a connector 52, a flexible tube 54, and a nozzle 56. The connector 52 has a through hole 521. The flexible tube 54 is fastened to the periphery of the connector 52 and kept in air communication with the through hole 521. When the connector 52 is connected to the socket 322 of the body 32 of the switching device 30, the through hole 521 is in air communication with the second passage 325 and the flexible tube 54. The connector 52 has two connection pegs 522 corresponding to the sliding slots 328 of the body 32 of the switching device 30. It is to be understood that the number of the connection pegs 522 according to this embodiment is just an example but not a limitation. The connection pegs 522 are respectively fastened to the sliding slots 328 to secure the connector 52 to the socket 322 of the body 32 of the switching device 30. When the connector 52 pushes the movable member 34 of the switching device 30 to the second position P2, the connection pegs 522 are moved along the sliding slots 328 into positive engagement with the socket 322. The flexible tube 54 has its two opposite ends respectively connected to the connector 52 and the nozzle 56, so that the nozzle 56 is in air communication with the second passage 325 of the body 32 of the switching device 30 for steam output.

The operation of the electric steam iron 10 is outlined hereinafter:

1. When the electric steam iron 10 is turned on, the movable member 34 of the switching device 30 is held in the first position P1 by the spring 35, and steam goes through the first outlet 326 of the body 32 of the switching device 30 to the steam holes 43 of the ironing unit 40 for making clothes smooth and flat.

2. For vertical ironing, the connector 52 of the cleaning device 50 is connected to the socket 322 of the body 32 of the switching device 30 to move the movable member 34 to the second position P2, for allowing steam to go through the second outlet 327 to the nozzle 56 of the cleaning device 50 for ironing clothes in vertical direction.

As stated above, the electric steam iron 10 of the present invention allows horizontal ironing as well as vertical ironing as desired, bringing convenience to the user.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electric steam iron comprising:

a steam generator having an output port for steam output;

a switching device including a body, which has an inlet in air communication with said output port of said steam generator, a first passage having a first end in air communication with said inlet and a second end terminating in a first outlet, and a second passage having a first end in air communication with said inlet and a second end terminating in a second outlet, and a movable member disposed in an intersection between said first passage and said second passage and movable between a first position where said second outlet is blocked and steam goes out of said first outlet and a second position where said first outlet is blocked and steam goes out of said second outlet; and an ironing unit having a connection hole in air communication with said first outlet for steam input, and a plurality of steam holes on a bottom side thereof in air communication with said connection hole for steam output; and a cleaning device including a connector connectable to the body of said switching device for pushing said movable member to said second position, a nozzle, and a flexible tube connected between said connector and said nozzle to guide steam from said second passage to said nozzle;

whereby when said movable member is in said first position, steam goes through said first outlet to the connection hole of said ironing unit; when said movable member is moved to said second position upon connection of said connector to the body of said switching device, steam goes through said second outlet to said nozzle of said cleaning device.

2. The electric steam iron as claimed in claim 1, wherein said movable member comprises a head and a body, said head having an outer diameter greater than that of the body of said movable member; said switching device further comprises a spring sleeved onto the body of said movable member and stopped between the head of said movable member and the body of said switching device to support said movable member in said first position.

3. The electric steam iron as claimed in claim 1, wherein the body of said switching device comprises at least one sliding slot; said connector comprises at least one coupling peg connectable to said sliding slot to secure said connector to the body of said switching device.

4. The electric steam iron as claimed in claim 1, wherein said connector comprises a through hole; said flexible tube is fastened to a periphery of said connector and kept in air communication with said through hole; when said connector is connected to the body of said switching device, said through hole is in air communication with said second passage and said flexible tube.

5. The electric steam iron as claimed in claim 3 wherein said sliding slot extends from one end of the body of said switching device in an axial direction and then in a transverse direction.

6. The electric steam iron as claimed in claim 1, wherein the body of said switching device includes a valve block and a socket affixed to a rear end of said valve block; said valve block accommodating said movable member.

* * * * *